United States Patent [19]

Krietmeier

[11] Patent Number: 4,802,821

[45] Date of Patent: Feb. 7, 1989

[54] AXIAL FLOW TURBINE

[75] Inventor: Franz Krietmeier, Baden, Switzerland

[73] Assignee: BBC Brown Boveri AG, Baden, Switzerland

[21] Appl. No.: 99,020

[22] Filed: Sep. 21, 1987

[30] Foreign Application Priority Data

Sep. 26, 1986 [CH] Switzerland ..... 3876/86

[51] Int. Cl.[4] ..... G01D 25/30

[52] U.S. Cl. ..... 415/210; 415/DIG. 1

[58] Field of Search ..... 415/207, 208, 209, 210, 415/219 R, DIG. 1

[56] References Cited

U.S. PATENT DOCUMENTS

| | | | |
|---|---|---|---|
| 2,538,739 | 1/1951 | Troller | 415/207 X |
| 2,828,939 | 4/1958 | Grey | 415/219 R X |
| 2,844,001 | 7/1958 | Alford | 415/207 X |
| 3,552,877 | 1/1971 | Christ et al. | 415/209 |
| 4,013,378 | 3/1977 | Herzog | 415/209 |
| 4,214,452 | 7/1980 | Riollet et al. | 415/DIG. 1 |
| 4,391,566 | 7/1983 | Takamura | 415/210 X |

FOREIGN PATENT DOCUMENTS

| | | | |
|---|---|---|---|
| 697997 | 10/1940 | Fed. Rep. of Germany | 415/207 |
| 1227290 | 10/1966 | Fed. Rep. of Germany . | |
| 2224249 | 11/1972 | Fed. Rep. of Germany . | |
| 352534 | 4/1961 | Switzerland . | |
| 512664 | 10/1971 | Switzerland . | |
| 2131100 | 6/1984 | United Kingdom | 415/207 |

*Primary Examiner*—Robert E. Garrett
*Assistant Examiner*—Joseph M. Pitko
*Attorney, Agent, or Firm*—Oblon, Fisher, Spivak, McClelland & Maier

[57] ABSTRACT

In an axial flow gas turbine with reaction blading, whose outlet rotor blades (14) are followed by a diffuser with axial outlet into an exhaust gas pipe (13), the kink angles of the diffuser inlet both at the hub (10) and at the cylinder (9) are fixed exclusively for the purpose of evening out the energy profile over the duct height at the outlet from the last rotor blade row in order to shorten the diffuser system and to optimise it in part load operation. In addition, a mechanism provided to remove swirl from the swirling flow in the form of profile ribs (17). Where the outlet rotor blades have a high Mach number flow, which leads to a large opening angle of the blading, the diffuser is subdivided into several partial diffusers (16) via sheet metal guides (15).

13 Claims, 3 Drawing Sheets

1
2
3
4
5
6
7
8
9
10
11
12
13
14
15
16
17
18
19
20
22
23
24
25'
25''
26
27
α
$\alpha_z$
$\alpha_N$

AXIAL FLOW TURBINE

BACKGROUND OF THE INVENTION

1. Field ofthe Invention

The invention concerns an axial flow turbine with reaction blading whose outlet rotor blades with high Mach number flow are followed by a diffuser with axial outlet into an exhaust gas pipe. Such systems are especially used in gas turbine construction. Generally speaking, the axial exhaust pipe emerges into a chimney through which the turbine exhaust gases are released into the atmosphere.

2. Description of the Prior Art

Because of the increase in volume of the exhaust gases, due to their expansion when flowing through the usually multi-stage turbine, the blading lengths of the guide vanes and rotor blades are matched to the changes in density. This produces a conical flow duct in which, depending on the type of design, both the inner boundary wall, i.e. the hub, and the outer boundary wall, i.e. the cylinder, may be inclined at a certain angle to the centre-line of the machine. In many designs, the hub is cylindrical with corresponding angular adaptation of the cylinder. In machines in which high Mach number flow occurs, the angle between the hub and the cylinder can easily attain 30° or more. As a consequence, the meridianal streamlines at the blading outlet extend over this angular rage. The diffuser for recovering the kinetic energy is downstream of this outlet. If the conicity were to be continued in a straight line, the angle mentioned (30°) would be completely unsuitable for retarding the flow and achieving the desired increase in pressure. The flow would separate from the walls.

The turbine designer knows that a diffuser angle of about 7° should not be exceeded. As a result, he will reduce the angle of 30° mentioned to 7° and connect the diffuser determined in this manner on the basis of practical considerations.

Investigations have shown that a diffuser with an axial outlet designed in this manner is unsuitable. The deflection of the streamlines at the kink positions of the diffuser inlet and the associated undesirable buildup of pressure reduces the drop, i.e. the gas works over the blading. This results in decreased power. The energy not employed leads to local excess velocities at the diffuser outlet and these are subsequently dissipated in the outlet gas pipe.

PRESENTATION OF THE INVENTION

The intention of the invention is to provide a remedy on this point. The invention is based on the objective of designing the diffuser for maximum pressure recovery, in particular including part load on the plant. According to the invention, this is achieved by fixing the kink angles of the diffuser inlet, both at the hub and the cylinder, exclusively for the purpose of evening out the energy profile over the duct height at the outlet from the last rotor blade row and by providing means for removing swirl from the swirling flow within the retardation zone.

The advantage of the invention may, inter alia, be seen in that a substantial reduction in the installation length can be achieved by means of a diffuser of this type.

Since the opening angle of conventional highly loaded blading far exceeds that of a good diffuser, it is desirable that (in order to support the flow) the diffuser should be subdivided in the radial direction by means of sheet metal flow guides into several partial diffusers. By this means, each individual partial diffuser can be designed in an optimum manner. Such sheet metal guides are, in fact, known from the exhaust steam casings of steam turbines, in which the expanded and axially emerging steam is transferred into a radial outlet flow direction. From the theory of curved diffusers, however, it is also known that in the technically possible relatively short installation lengths and meridional deflections approaching 90°, i.e. from the axial to the radial direction, only slight retardation takes place. In the normal case, therefore, these known sheet metal guides do not form boundaries to partial diffusers but are only deflection aids.

A particularly effective arrangement is where the sheet metal guides are single-piece rings without joints, some of the rings at least extending over the whole of the diffuser length. Because of the resulting disappearance of flange connections, the free flow cross-section is, on the one hand, increased. On the other hand, the rotational symmetry of the guide sheets has a very favourable effect on the vibration behaviour of the system.

If the end part of the diffuser is designed as a Carnot diffuser, this permits a further shortening of the overall diffuser to be achieved without aerodynamic disadvantages having to be accepted.

It is desirable that the means for removing the swirl within the diffuser should consist of at least three uncurved or curved flow ribs which have thick profiles, are evenly distributed over the periphery and extend over the complete height of the flow duct. This configuration makes the ribs insensitive to oblique incident flow.

If the boundary walls of the diffuser are designed in such a way that there is only a modest change in cross-section in the diffuser in the front region of the flow ribs, separation-free deflection will be both introduced and achieved by this measure.

It is desirable that the flow ribs should have, in their radial extension, a hollow space through which the interior of the hub of the diffuser can be reached. By this means, the bearing and the internal pipework are accessible at any time without dismantling the diffuser.

It is advantageous for the flow ribs to form load-carrying bodies for the guide rings in such a way that the correspondingly cut out rings are fastened, preferably welded, to the support body in the profile longitudinal extension. Stable connections can be manufactured by this means while avoiding the otherwise necessary support ribs.

It is appropriate for the front edge of the flow ribs subject to the incident flow to be located at a distance from the outlet plane of the turbine blading such that a diffuser area ratio of at least 2, preferably 3, is available. The first diffuser zone therefore remains undisturbed because of the total rotational symmetry, this leading to the greatest possible retardation in the shortest possible installation length. Because the ribs only become effective at a plane in which there is already a relatively low energy level, no interference effects are to be expected between the ribs and the blading. The specific losses due to the ribs are also small.

In order to provide a good inspection capability for the last blading row, it is advantageous if some of the guide rings extend in the longitudinal direction of the machine only to that plane in which the support body has its greatest profile thickness. By this means, personnel can penetrate without hindrance as far as the narrowest position between the outer and/or inner boundary wall of the diffuser and the flow rib.

From the thermal technology point of view, it is particularly useful to support the diffuser in an exhaust gas casing which is bolted to the turbine casing. The hub end, inner exhaust gas casing parts are then connected to the outer exhaust gas casing parts surrounding the diffuser by means of load-carrying ribs which preferably penetrate the hollow space of the flow ribs. This permits the load-carrying structure to be kept at a lower and homogeneous temperature level with effects on the deformation behaviour permitting, in turn, smaller blade clearances.

It is recommended that the load-carrying ribs be made hollow and accessible because the thick profiles of the flow ribs offer this possibility.

If the inner and outer exhaust gas casing parts are designed as single-piece shell casings without joints, favourable deformation behaviour is again to be expected because of the rotational symmetry.

The system becomes particularly maintenance-friendly if the exhaust gas casing/diffuser unit can be displaced axially into the exhaust gas pipe. When the machine has to be dismantled, the exhaust gas pipe, which is generally built into the wall of the machine building, can then be left in place.

In order to cool the flow guidance and load-carrying elements, it is appropriate to connect the inner annular duct formed from the inner exhaust gas casing part and the inner diffuser boundary wall with the outer annular duct formed from the outer exhaust gas casing part and the outer diffuser boundary wall by means of the hollow spaces of the flow ribs. If an adequate coolant, for example appropriately treated rotor cooling air, flows through cooling ducts formed in such a way, the whole of the load-carrying structure can be kept to a low, homogeneous temperature level.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Only the elements essential for understanding the invention are shown. Not shown, for example, are the compressor part, the combustion chamber and the first stages of the gas turbine part, on the one hand, and the complete exhaust gas pipe and the chimney, on the other. The flow direction of the various media is indicated by arrows.

Method of Carrying Out the Invention

Figure 1:
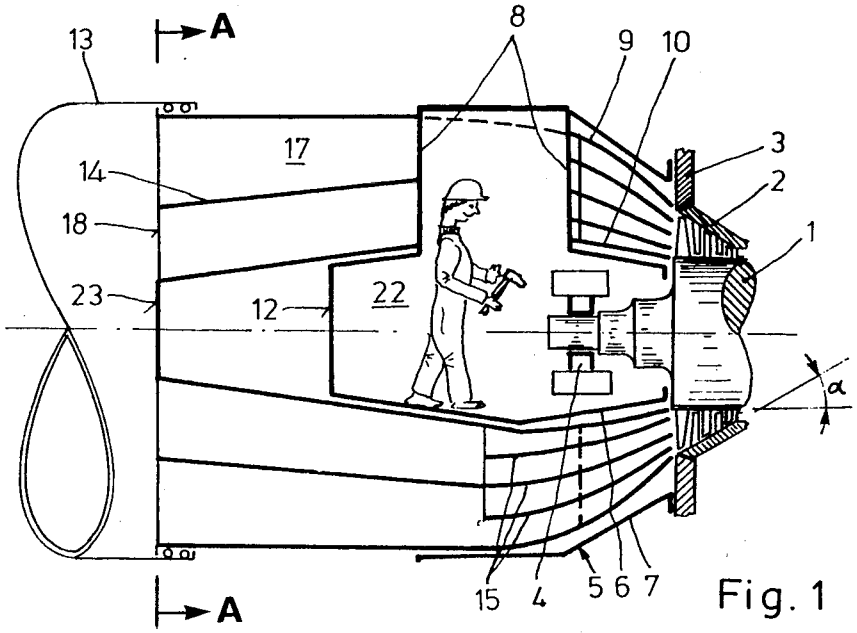
FIG. 1 shows a diagrammatic sketch of the complete diffuser system in principle.
Figure 4:
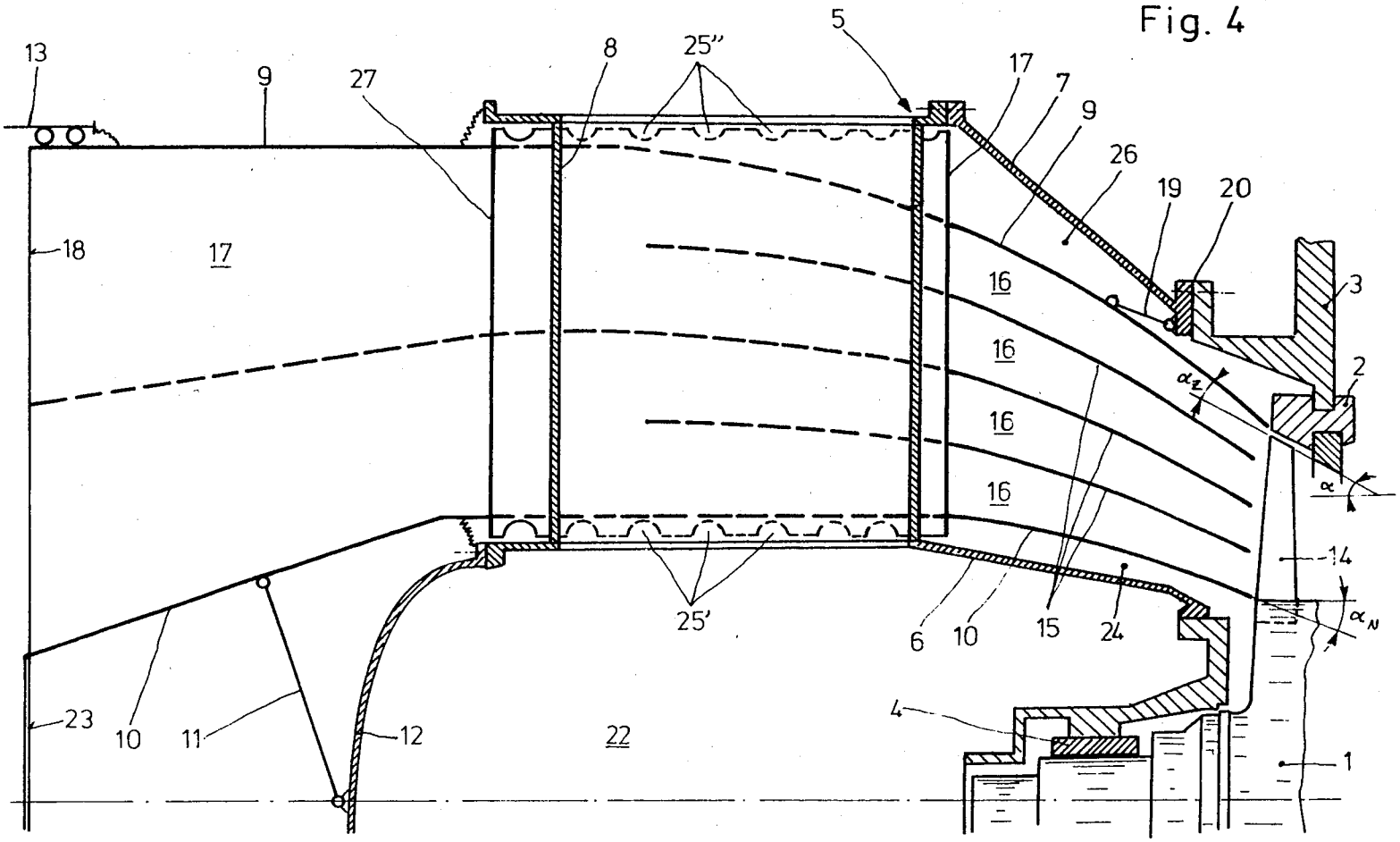
FIG. 4 shows a partial longitudinal section of the diffuser to an increased scale.
Figure 5:
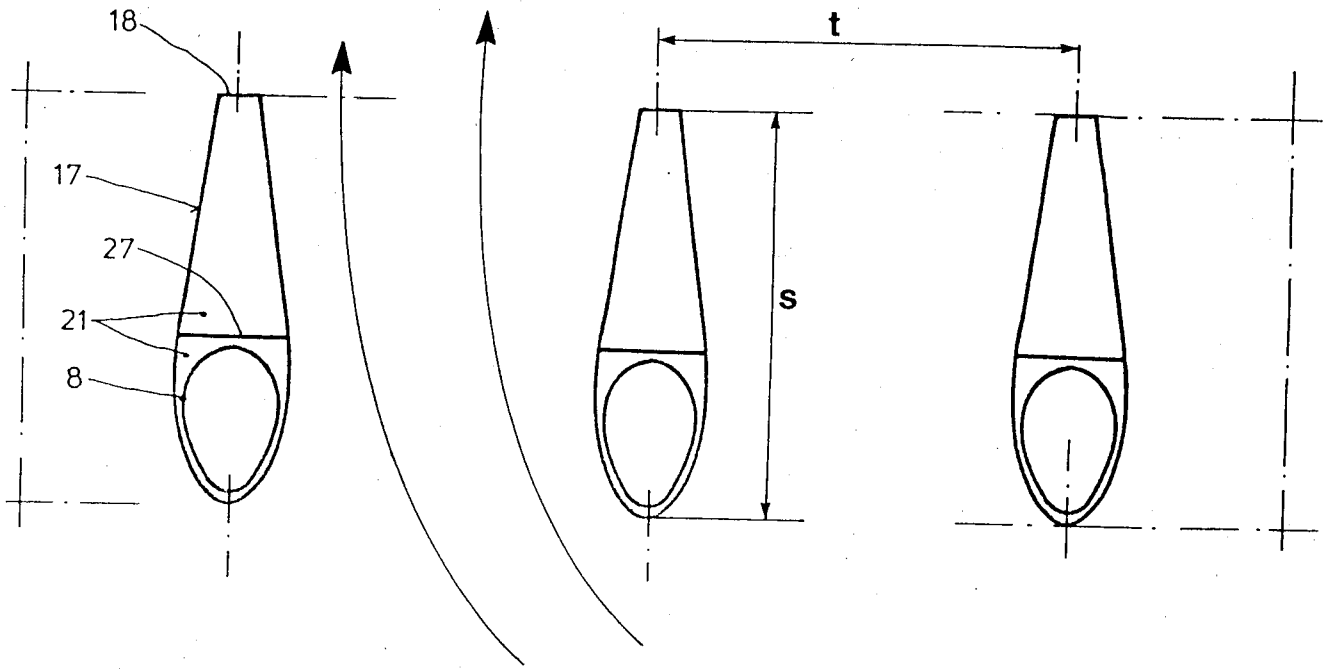
FIG. 5 shows the development of a cylindrical section at mean diameter along the section line B—B in FIG. 3.

The gas turbine, of which only the last three, axial flow stages are shown in FIG. 1, consists essentially of the bladed rotor 1 and the vane carrier 2 equipped with guide vanes. The vane carrier is suspended in the turbine casing 3. The rotor 1 is carried in a support bearing 4 which is in turn supported in an exhaust gas casing 5. This exhaust gas casing 5 consists essentially of a hub-side, inner part 6 and an outer part 7. Both elements are single-piece shell casings without axial split planes. They are connected together by three welded load-carrying ribs 8 which are evenly distributed around the periphery. The load-carrying ribs 8 are made hollow. By this means, it is possible to reach the hub internals 22 of the exhaust gas casing, as represented symbolically by the fitter in FIG. 1. The space relationships make it possible to carry out even fairly large bearing work such as, for example, the lifting of the bearing cover. The supply lines from the system can also be led out through these hollow load-carrying ribs 8. In addition, the ribs have the function of transmitting the bearing forces from the inner casing part 6 to the outer casing part 7. The outer casing part 7 is connected to the turbine casing 3 via a bolted flange connections 20 (FIG. 4).

The exhaust gas casing 5 is designed in such a way that it is not in contact with the exhaust gas flow. The actual flow guidance is undertaken by the diffuser which is designed as an insert in the exhaust gas casing. As may be seen in FIG. 4, the outer boundary wall 9 of the diffuser is supported, via sheet metal parts 19, together with the outer exhaust gas casing part 7, on the turbine casing 3; the inner boundary wall 10, on the other hand, is suspended via struts 11 on the hub cap 12 of the inner exhaust gas casing part 6. The end part of the diffuser emerges into the exhaust gas pipe 13.

The critical feature for the desired mode of operation of the diffuser is the kink angle of its two boundary walls 9 and 10 immediately at the outlet from the blading. From the large opening angle $\alpha$ in FIG. 1, it may be seen that the blading of the gas turbine is highly loaded reaction blading, the flow through the last row of rotor blades being, as a consequence, at a high Mach number. FIG. 4 shows that the contour at the blade root is cylindrical with a corresponding slope at the tip of the rotor blades 14. The conicity is approximately 30°. The designer would now like to reduce this angle to approximately 7° in such a way that, for example, the hub contour and the cylinder contour are set to make the geometrical mid-height line of the last turbine stage agree with that of the diffuser entry.

According to the invention, however, this procedure is to be avoided under all circumstances. As soon as the blading has been fixed and, in consequence, the flow conditions are known at outlet from the blading, the diffuser is designed and this is, in fact, done independent of design considerations and exclusively from aerodynamic considerations. The two kink angles must be determined on the basis of the overall flow in the blading and the diffuser even taking account, if required, of the influence of the combustion chamber.

It is therefore necessary to establish flow considerations which do not cause the damaging build-up of pressure at the hub and cylinder, mentioned at the beginning, but generate the most homogeneous energy profile possible at these points.

If the radial equilibrium equation is considered, it is the meridional curvature of the streamlines which is mainly responsible for the magnitude of the pressure increase mentioned. This must be influenced primarily by adaptation of the angle of incidence in order to achieve a homogeneous energy distribution. This, in principle, fixes the kink angle of the inner boundary wall at diffuser inlet. In the present case, this leads to an angle $\alpha_N$ which rises from the horizontal in a positive direction. It may be seen that the angle is almost 20°. This may be attributed, among other things, to the influence of the cooling air. As is known, the hub, i.e. the rotor surface and the root of the rotor blades, are generally cooled by cooling air down to a tolerable level. Part of this cooling air flows along the rotor surface into the main duct. This cooling air has a lower temperature than the main flow, which causes low energy zones, so-called energy gaps, directly at the hub behind the last rotor blade. This fact, specific to gas turbines, means that, instead of the energy deficit, the pressure gradient mentioned must be forced at this position. This is achieved by increased incidence on the inner boundary wall 10 and a meridional deflection of the flow caused by it. The energy built up by this prevents separation of the flow at the hub of the diffuser.

From all of this, it may be seen that an arbitrary (for example cylindrical) continuation of the inner boundary wall of the diffuser would in no case be a suitable way of compensating for the typical energy deficit in the outlet flow.

The same considerations are now applied to the cylinder. Here, however, it is necessary to allow for the fact that the flow is very energetic because of the flow through the gap between the blade tips and the blade carrier 2. In addition, it has a strong swirl. Homogeneous energy distribution can only be achieved here if the kink angle at the cylinder opens outwards relative to the slope of the blading duct in every case. In the present case, it is indicated by $\alpha_Z$ and has a magnitude of about 10°.

The result is, therefore, that the overall opening angle of the diffuser is in the region of the opening angle of the blading and can even be greater than the latter. In no case, however, does it have the value corresponding to purely design considerations.

This produces the conditions necessary for the pressure conversion in the following diffuser to take place in such a way that there is a homogeneous, even outlet flow at its exit.

It is, however, clear that a diffuser with a 30° opening angle is unsuitable for retarding the flow. In the radial direction, therefore, it is sub-divided by means of sheet metal flow guides 15 into partial diffusers. These can now be dimensioned according to the known rules. In the present case, this means that three guide sheets 15 are arranged so as to produce four partial diffusers 16 with an opening angle of 7.5° each.

Although this solution is fundamentally known from short installation length source-type diffusers, it should not be forgotten that in the case of these known diffusers, the kink angle at the diffuser inlet depends arbitrarily on the number of partial diffusers. As has been shown, however, arbitrary kink angles are completely unsuitable in turbomachines because of the specific outlet flow relationships of the latter.

In order to improve the vibration behaviour, these sheet metal guides 15 are designed as single-piece rings or truncated cones. Because they are made rotationally symmetrical and have no split flanges, they provide the best conditions for undisturbed pressure conversion in the flow which has, up to this point, still contained swirl. In order to obtain the best possible pressure recovery in this manner, the guide rings 15 extend without any cross-sectional limitations as far as a plane at which a diffuser area ratio of 3 has been attained. This section is considered to be the first diffuser zone.

Now these guide sheets 15 must be fastened in the diffuser in an appropriate manner and held at a distance from one another. The classical ribs offer themselves as the immediate possibility. On the other hand, the invention also envisages achieving the best possible pressure recovery at part load. This leads to the requirement to remove the swirl from the flow which, again, can be achieved in the classical manner by straightening ribs. In the present case, both functions can be combined using one and the same means, namely flow ribs 17.

Figure 2:
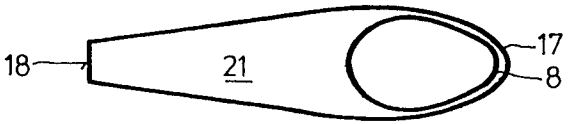
FIG. 2 shows a plan view on an isolated flow rib.

Three straight flow ribs are arranged in the diffuser evenly distributed around the periphery. These ribs have thick profiles which are designed from knowledge of turbomachinery construction and are insensitive to oblique incident flow. If a pitch/chord ratio of about 1 is assumed, it may be seen that these profiles will have a very large chord when there are only three ribs around the periphery. In fact, they actually extend as far as the end of the diffuser. They extend over the whole of the duct height of the diffuser and thus simultaneously connect together the diffuser's inner and outer boundary walls 10, 9. The ribs are welded to these boundary walls 10, 9. They are made hollow and because of their thickness at the entry end, this hollow space 21 is suitable for accepting the load-carrying rib 8 of the exhaust gas casing 5. It is obvious that the shape of the hollow load-carrying ribs 8 should be matched to the contour of the flow ribs in order to achieve the largest possible accessible space, as can be seen from FIG. 2.

The sheet metal guides are fastened to the three flow ribs 17 by welding. For this purpose, the guide sheets have cut-outs corresponding to the profile shape of the ribs. Because of the long weld seams, stable connection is ensured, which permits the long overhang of the sheet metal guides over the whole of the first diffuser zone.

It may be seen from FIGS. 1 and 4 that only the central sheet metal guide reaches as far as the end of the diffuser. The lower part of FIG. 1 shows that the sheet metal guides located between the central sheet metal guide and the boundary walls end in the plane in which the flow ribs 17 have their maximum thickness. From its end, therefore, access is available to the diffuser to a point where, for example, the last rotor row of the gas turbine can, without difficulty, be subjected to direct optical inspection.

As already mentioned, the first diffuser zone ends in the plane of the leading edge of the flow rib 17. A second zone extends from the leading edge to the maximum profile thickness of the ribs. In this zone, the boundary walls 9 and 10 of the diffuser are matched to the profile of the rib in such a way that the flow in the second zone, in which most of the swirl is removed, is substantially free from retardation.

The second zone is followed by a third zone in which retardation resumes. The central sheet metal guides and the flow ribs extend along this third zone. This zone, in the main, is a straight diffuser. Since the flow is now substantially swirl-free, it is necessary to ensure that the increase in area is not too great, in order to prevent separation of the flow on the boundary walls 9 (which extend cylindrically in this zone). In order to prevent the length of the system from becoming excessive, the inner boundary walls 10 of the diffuser are not permitted to run out completely but are limited in their axial extent by a blunt cut-off 23.

Figure 3:
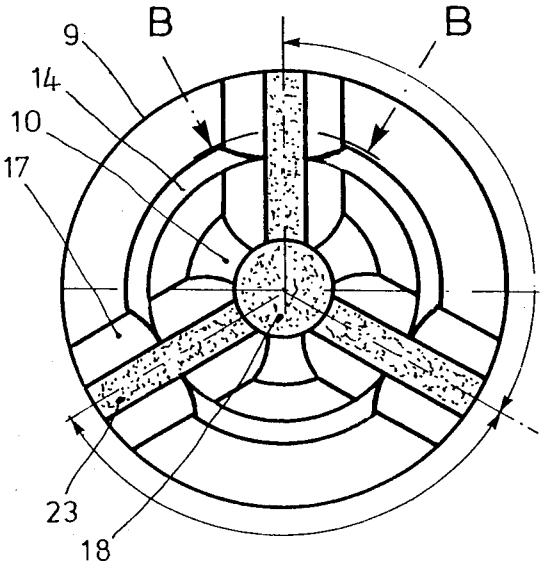
FIG. 3 shows a cross-section through the section plane A—A in FIG. 1.

The flow ribs 17 end in the same plane as the inner diffuser walls 10 with, again, a blunt cut-off 18 which determines the outlet flow edges of the profile. Together with the full cross-section of the cylindrical exhaust gas pipe 13, a type of Carnot diffuser is formed in a fourth zone by the sudden increase in area, which again contributes to shortening the installation length. As may be seen in FIG. 3, correct functioning of this Carnot diffuser only requires that the dotted area (which is made up of the blunt ends of the three ribs and the blunt end of the inner boundary walls) should be less than 20% of the circular area of the outlet gas pipe 13.

Since both the essential load-carrying and the flow guidance elements are of one-piece construction, provision is made (for dismantling the turbines) for the exhaust gas casing and diffuser elements, which form one functional unit, to be designed so that they can be displaced as a whole. The unit can be moved into the exhaust gas pipe 13 at least by the amount necessary to lift the rotor 1 from the support bearing 4 without difficulty. Since the support bearing, in the case of the fully assembled installation, is supported within the exhaust gas casing part 6 which also has to be moved, arrangements are therefore made, for this purpose, to provide an auxiliary support for the rotor 1, preferably in the plane of the compressor diffuser (which is not shown).

For purposes of cooling and temperature homogenisation, particularly of the load-supporting structure of the exhaust gas casing 5, provision is made for this structure to be subjected to prepared cooling air. For this purpose, the cooling medium is introduced downstream of the blading into the annular duct 24 between the inner exhaust gas casing part 5 and the inner diffuser boundary wall 10. It may be seen from FIG. 4 that the parts of the flow ribs 17 protruding beyond the flow duct are perforated on both their inner and their outer ends. The cooling medium passes through the inner cooling air openings 25' into the hollow space 21 of the ribs (FIG. 6). The front part of this hollow space is screened off from the downstream end of the profile by a separating wall 27 extending over the complete duct height. In consequence of this, the load-carrying ribs 8 are actually located in a cooling space through which flow occurs in a radial direction from the inside to the outside. At the outer end, the cooling air flows via the corresponding cooling air opening 25'' into the annular duct 26 (FIG. 7) between the outer exhaust gas casing part 7 and the outer diffuser boundary wall 9. In order to cool these walls, the medium is led back to the diffuser entry where it is added directly behind the outlet edge of the rotor blades 14 to the clearance flow and the main flow as aerodynamic ballast. This cooling air proportion is, of course, also taken into account in the determination of the kink angle $\alpha_Z$.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Axial flow turbine comprising reaction blading having outlet rotor blades (14) with a high Mach number flow and a large opening angle and which are followed by a diffuser with axial outlet into an exhaust gas pipe (13), wherein kink angles ($\alpha_N$, $\alpha_Z$) of an inlet of the diffuser both at an inner boundary wall of the diffuser and at an outer boundary wall of the diffusor are fixed so as to even out the energy profile over the height at an outlet portion from a last rotor blade row and wherein means for removing swirl from the swirling flow are provided within a diffuser zone.

2. Turbine according to claim 1, wherein the diffuser is subdivided in the radial direction into a plurality of partial diffusers (16) by means of sheet metal flow guides (15).

3. Turbine according to claim 2, wherein the sheet metal guides (15) comprise a plurality of single-piece rings without joints, wherein some of the rings at least extend over the entire diffuser zone.

4. Turbine according to claim 3, wherein said means for removing the swirl within the diffuser comprises at least three flow ribs (17) evenly distributed over the periphery of said outer boundary wall of the diffuser and extending radially over a complete height dimension of a flow duct formed by the diffuser.

5. Turbine according to claim 4, wherein the flow ribs (17), in a radial direction, have a hollow space (21) formed therein through which an internal portion of the hub of the exhaust gas casing can be reached.

6. Turbine according to claim 5, further comprising an exhaust gas casing (5) which is bolted to the turbine casing (3) and which supports said diffuser, wherein a hub-end inner exhaust gas casing part (6) is connected to an outer exhaust gas casing part (7) surrounding the diffuser by means of load-carrying ribs (8) which penetrate the hollow space (21) of the flow ribs (17).

7. Turbine according to claim 6, wherein the load-carrying ribs (8) are hollow.

8. Turbine according to claim 6, wherein the inner and outer exhaust gas casing parts (6, 7) comprise single-piece shell casings.

9. Turbine according to claim 6, wherein an inner annular duct (24) formed by the inner exhaust gas casing part (6) and by the inner boundary wall (10) of the diffuser is connected to an outer annular duct (26) formed by the outer exhaust gas casing part (7) and the outer diffuser boundary wall (9) via the hollow space (21).

10. Turbine according to claim 4, wherein the flow ribs (17) form load-carrying bodies for the sheet metal guides (15) such that the correspondingly cut out rings are fastened.

11. Turbine according to claim 10, wherein a part of the sheet metal guides (15) extends in the machine longitudinal direction only as far as a plane in which the flow ribs (17) have a maximum profile thickness.

12. Turbine according to claim 4, wherein a front edge portion of the flow ribs (17) is located at a distance from the outlet plane of the turbine blading, such that there is a ratio of the area at the front end of the flow ribs and the area of the diffuser inlet of at least 2.

13. Turbine according to claim 1, characterized in that a diffuser end part in a plane of an outlet flow edge (18) of said means for removing swirl comprises a Carnot diffuser.

* * * * *

UNITED STATES PATENT AND TRADEMARK OFFICE

CERTIFICATE OF CORRECTION

PATENT NO. : 4,802,821

DATED : Feb. 7, 1989

INVENTOR(S) : Franz KREITMEIER

It is certified that error appears in the above-identified patent and that said Letters Patent is hereby corrected as shown below:

Title page, item [19] and [75]:

The spelling of the inventor's name is corrected as follows:

--Kreitmeier--

Signed and Sealed this

Eleventh Day of July, 1989

*Attest:*

DONALD J. QUIGG

*Attesting Officer*

*Commissioner of Patents and Trademarks*